US010508806B2

(12) United States Patent
Sherikar

(10) Patent No.: US 10,508,806 B2
(45) Date of Patent: Dec. 17, 2019

(54) SPRAY NOZZLE ASSEMBLY FOR STEAM-DESUPERHEATING, STEAM-DESUPERHEATING DEVICE USING SAME, AND METHOD OF STEAM-DESUPERHEATING USING SAME

(71) Applicant: NIHON KOSO CO., LTD., Chuo-ku, Tokyo (JP)

(72) Inventor: Sanjay Sherikar, Mission Viejo, CA (US)

(73) Assignee: NIHON KOSO CO., LTD., Tokyo (JP)

( * ) Notice: Subject to any disclaimer, the term of this patent is extended or adjusted under 35 U.S.C. 154(b) by 15 days.

(21) Appl. No.: 15/147,735

(22) Filed: May 5, 2016

(65) Prior Publication Data

US 2017/0321884 A1 Nov. 9, 2017

(51) Int. Cl.
*F22G 5/12* (2006.01)
*B05B 1/20* (2006.01)

(52) U.S. Cl.
CPC ..... *F22G 5/123* (2013.01); *B05B 1/20* (2013.01)

(58) Field of Classification Search
CPC ... F22G 5/123; F22G 5/12; B05B 1/26; B05B 1/262; B05B 1/28; B05B 1/3073; B05B 1/308
USPC ..... 239/451
See application file for complete search history.

(56) References Cited

U.S. PATENT DOCUMENTS 2,354,842 A * 8/1944 Paulsen ..... F22G 5/12 261/116
3,219,323 A * 11/1965 Dexter ..... C21D 9/0037 261/16
3,302,399 A * 2/1967 Tini ..... B05B 1/262 239/552
6,276,823 B1 * 8/2001 King ..... F22G 5/123 366/181.5
6,746,001 B1 6/2004 Sherikar
7,850,149 B2 * 12/2010 Sherikar ..... B05B 1/3006 122/487
8,931,717 B2 1/2015 Watson et al.
2004/0112976 A1 * 6/2004 Galvin ..... B05B 1/265 239/2.2
2009/0065295 A1 * 3/2009 Sherikar ..... F16L 55/02727 181/233

(Continued)

FOREIGN PATENT DOCUMENTS

WO 2014055691 A1 4/2014

OTHER PUBLICATIONS

Sherikar et al., Characteristics of High Capacity Cone Sprays Injected into a Crossflow, ILASS Americas, May 2004, p. 1-9, 17th Annual Conference on Liquid Atomization and Spray Systems, Arlington, VA.

*Primary Examiner* — Steven B McAllister
*Assistant Examiner* — Ko-Wei Lin
(74) *Attorney, Agent, or Firm* — Law Office of Katsuhiro Arai

(57) ABSTRACT

A nozzle assembly for spraying cooling fluid in a steam-desuperheating device, includes: a nozzle body; a plug element movably attached to the nozzle body; and a splitter member fixed to a front face of the plug element. The splitter member has at least one splitter arm extending across the flow passage formed in the nozzle body as viewed from the front of the plug element to deflect flow of fluid sprayed through the flow passage.

11 Claims, 8 Drawing Sheets

(56) References Cited

U.S. PATENT DOCUMENTS

| | | | | |
|---|---|---|---|---|
| 2009/0277364 | A1* | 11/2009 | Donais | F23C 7/008 110/263 |
| 2012/0193294 | A1* | 8/2012 | Amato | B03D 1/1431 210/703 |
| 2013/0074788 | A1* | 3/2013 | Ignatan | F22G 5/123 122/479.1 |

* cited by examiner

SPRAY NOZZLE ASSEMBLY FOR STEAM-DESUPERHEATING, STEAM-DESUPERHEATING DEVICE USING SAME, AND METHOD OF STEAM-DESUPERHEATING USING SAME

BACKGROUND OF THE INVENTION

Field of the Invention

The present invention generally relates a spray nozzle assembly for steam-desuperheating, a steam-desuperheating device using the nozzle assembly, and a method of steam-desuperheating using the device.

Description of the Related Art

Many industrial facilities operate with superheated steam that has a higher temperature than its saturation temperature at a given pressure. However, a high amount of heat (superheat) in the steam can damage turbines or other downstream components, and thus, it is necessary to control the temperature of the steam. Desuperheating refers to the process of reducing the temperature of the superheated steam to a lower temperature, permitting operation of the system as intended, ensuring system protection, and correcting for unintentional deviations from the setpoint.

A steam desuperheater can lower the temperature of superheated steam by spraying cooling water into a flow of superheated steam that is passing through a steam pipe. Once the cooling water is sprayed into the flow of superheated steam, the cooling water mixes with the superheated steam and evaporates, drawing thermal energy from the steam and lowering its temperature. If the cooling water is sprayed into the superheated steam pipe as very fine water droplets or mist, then the evaporation of the cooling water in the superheated steam is fast, which is desirable. Conventionally, therefore, much effort has been made to ensure that water droplets have sufficiently small sizes.

Another critical requirement for efficient evaporation is good mixing of injected cooling water in the steam flow. In conventional methods wherein cooling water is sprayed into the steam pipe in a uniform conical pattern, mixing occurs primarily because of turbulence in the steam flow. In search of ways to improve the desuperheating process, the present inventor has conceived segmenting the spray pattern, and means to achieve such effect, to increase the mixing of the steam flow and the injected cooling water, and completed the invention.

Any discussion of problems and solutions in relation to the related art has been included in this disclosure solely for the purposes of providing a context for the present invention, and should not be taken as an admission that any or all of the discussion was known at the time the invention was made.

SUMMARY OF THE INVENTION

Some embodiments provide an improved nozzle assembly for desuperheating. In an embodiment, a nozzle assembly is provided with a splitter member which cuts a spray pattern into multiple segments. In a first embodiment, the nozzle assembly is used in a probe-type desuperheater, and the segmentation of the spray pattern can entrain surrounding hot steam within the core of the spray pattern, i.e., hot steam flows through the gaps between the segments and is enveloped by the cooling fluid flow, improving the mixing of the steam and the sprayed cooling fluid and increasing the evaporation rate of the cooling fluid, which are desirable in desuperheaters. It also allows injection of cooling fluid against the steam or vapor flow (counter flow injection) with minimal potential for droplets of cooling fluid to hit the probe-type desuperheater, wherein droplets of cooling fluid flow in segments and go around the probe located between the segments.

In a second embodiment, a nozzle assembly is used in a multi-nozzle ring desuperheater, wherein injection of cooling fluid is performed in a direction perpendicular to the steam or vapor flow (radial flow injection). In the second embodiment, the segmentation of the spray pattern entrains surrounding hot steam within the core of the spray pattern in the same manner as in the first embodiment, improving the mixing of the steam and the sprayed cooling fluid and increasing the evaporation rate of the cooling fluid, which are desirable in desuperheaters.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DETAILED DESCRIPTION OF EMBODIMENTS

Figure 1:
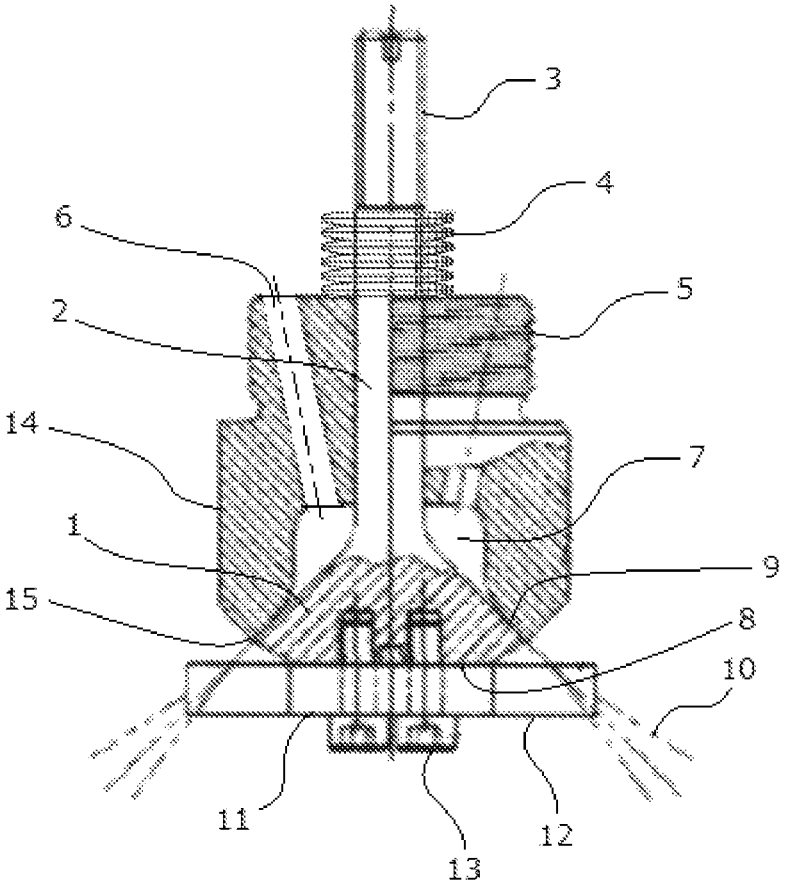
FIG. 1 is a schematic partial cross sectional view of a nozzle assembly according to an embodiment of the present invention.

In this disclosure, "steam" may include vaporized liquid which may be constituted by a mist of minute liquid droplets in gas (e.g., air) and may be constituted by a single vapor or a mixture of vapors, and typically the liquid is water. Also, in this disclosure, "cooling fluid" refers to a substance which is able to easily flow and form a mist of minute liquid droplets by being sprayed for cooling steam, and which is typically the same liquid as that constituting "steam"; however, in some embodiments, "cooling fluid" may be different from liquid constituting steam. Additionally, in this disclosure, an article "a" or "an" refers to a species or a genus including multiple species. Further, in this disclosure, any two numbers of a variable can constitute a workable range of the variable as the workable range can be determined based on routine work, and any ranges indicated may include or exclude the endpoints. Additionally, any values of variables indicated (regardless of whether they are indicated with "about" or not) may refer to precise values or approximate values and include equivalents, and may refer to average, median, representative, majority, etc. in some embodiments. The terms "constituted by" and "having" refer independently to "typically or broadly comprising," "comprising," "consisting essentially of" or "consisting of" in some embodiments.

In the present disclosure where conditions and/or structures are not specified, the skilled artisan in the art can readily provide such conditions and/or structures, in view of the present disclosure, as a matter of routine experimentation.

In all of the disclosed embodiments, any element used in an embodiment can be replaced with any elements equivalent thereto, including those explicitly, necessarily, or inherently disclosed herein, for the intended purposes. Further, the present invention can equally be applied to apparatuses and methods.

In this disclosure, any defined meanings do not necessarily exclude ordinary and customary meanings in some embodiments.

The embodiments will be explained with respect to preferred embodiments. However, the present invention is not limited to the preferred embodiments.

In some embodiments, a nozzle assembly for spraying cooling fluid in a steam-desuperheating device, comprises: (i) a nozzle body defining a seating area and having an opening defining a flow passage extending through the seating area; (ii) a plug element movably attached to the nozzle body in the opening and selectively movable between closed and open positions relative thereto, wherein the plug element is seated against the seating area to close the flow passage in the closed position, and the plug element is away from the seating area to open the flow passage in the open position; and (iii) a splitter member fixed to a front face of the plug element, said splitter member having at least one splitter arm extending across the flow passage as viewed from the front of the plug element to cut the conical flow pattern of fluid sprayed through the flow passage.

In some embodiments, the splitter arm has a cross section which is a triangle with an apex facing the flow passage. In some embodiments, an angle at the apex of the triangle is about 25° to about 60° or any other suitable angles. In some embodiments, the at least one splitter arm is constituted by two splitter arms symmetrically extending in opposite directions. In some embodiments, the at least one splitter arm is constituted by three or more (e.g., four) splitter arms symmetrically extending in three or more respective directions. The symmetrical arrangement (e.g., line symmetry or point symmetry) of the splitter arms can create symmetrical segments of flow of sprayed cooling fluid and improve steam entrainment to the sprayed cooling fluid. In some embodiments, the nozzle assembly further comprises a biasing member disposed with a stem of the plug element to continuously bias the plug element toward the closed position. In some embodiments, the plug element has an outer diameter equivalent to an outer diameter of the opening of the nozzle body. In some embodiments, the splitter member is fixed to the front face of the plug element with screws or any other fastening tools.

In another aspect of the present invention, a probe-type steam-desuperheating device comprises: (a) a feeding pipe for feeding cooling fluid, having a lower end and an upper end; (b) a nozzle holder attached to the lower end of the feeding pipe; (c) a cooling fluid inlet port disposed at the upper end of the feeding pipe; (d) a flange provided in the feeding pipe, for attaching the feeding pipe to a steam pipe; and (e) at least one of the nozzle assembly disclosed herein attached to the nozzle holder in a manner such that an axis of the plug element is parallel to an axis of the steam pipe, wherein a length of the feeding pipe between the flange and the nozzle holder is set such that the axis of the plug element is aligned with the axis of the steam pipe. Depending on the size of the steam pipe, two or more nozzle assemblies can be installed on the same plane or different planes perpendicular to the axis of the steam pipe.

In some embodiments, the nozzle holder is disposed in a direction such that the front face of the plug element faces an upstream direction of steam flowing through the steam pipe. Alternatively, in some embodiments, the nozzle holder is disposed in a direction such that the front face of the plug element faces a downstream direction of steam flowing through the steam pipe. In some embodiments, the splitter arm extends in a direction in which the feeding pipe extends from the nozzle holder.

In still another aspect of the present invention, a multi-nozzle ring-type steam-desuperheating device comprises: (A) a circular feeding pipe with multiple branches for feeding cooling fluid having multiple branch ends and an upper end; (B) multiple nozzle holders attached to the multiple branch ends of the feeding pipe, respectively; (C) a cooling fluid inlet port disposed at the upper end of the feeding pipe; and (D) a plurality of the nozzle assemblies of claim 1 attached to the nozzle holders, respectively, in a manner such that each nozzle assembly is configured to gas-tightly communicate with the interior of a steam pipe, and an axis of each plug element is perpendicular to an axis of a steam pipe.

In some embodiments, each nozzle body is configured to gas-tightly communicate with the interior of the steam pipe. In some embodiments, the nozzle arm extends along an axis of the steam pipe.

In yet another aspect of the present invention, a method of desuperheating steam using any of the probe-type steam-desuperheating device disclosed herein, comprises: (I) supplying superheated steam in the steam pipe upstream of the probe-type steam-desuperheating device; (II) feeding cooling fluid to the cooling fluid inlet port of the probe-type steam-desuperheating device and spraying the cooling fluid from the nozzle assembly against flow of the superheated steam, thereby desuperheating the superheated steam while the superheated steam is passing through the probe-type steam-desuperheating device, wherein the cooling fluid sprayed out of the flow passage of the nozzle assembly flows against the flow of the superheated steam, and deflects to the direction of the flow of the superheated steam, wherein the cooling fluid sprayed out of the flow passage of the nozzle assembly is split into two streams by the splitter arm, which streams pass through the feeding pipe without hitting the feeding pipe; and (III) obtaining the desuperheated steam downstream of the probe-type steam-desuperheating device. Alternatively, in some embodiments, a method of desuperheating steam using any of the probe-type steam-desuperheating devices disclosed herein, comprises: (I') supplying superheated steam in the steam pipe upstream of the probe-type steam-desuperheating device; (II') feeding cooling fluid to the cooling fluid inlet port of the probe-type steam-desuperheating device and spraying the cooling fluid from the nozzle assembly toward a downstream direction of the superheated steam, wherein the cooling fluid sprayed out of the flow passage of the nozzle assembly flows toward the downstream direction of the superheated steam, wherein the cooling fluid sprayed out of the flow passage of the nozzle assembly is split into two streams by each splitter arm, between which streams part of the superheated steam passes, thereby desuperheating the superheated steam while the superheated steam is passing through the sprayed cooling fluid; and (III') obtaining the desuperheated steam downstream of the probe-type steam-desuperheating device.

In some embodiments, the at least one splitter arm is constituted by multiple splitter arms symmetrically extending in multiple directions, thereby creating symmetrical segments of flow of sprayed cooling fluid and improving steam entrainment to the sprayed cooling fluid. In some embodiments, the steam is water vapor, and the cooling fluid is water.

The embodiments will be further explained with reference to the drawings; however, the embodiments are not intended to limit the present invention.

FIG. 1 is a schematic partial cross sectional view of a nozzle assembly according to an embodiment of the present invention. The nozzle assembly illustrated in FIG. 1 is for spraying cooling fluid in a steam-desuperheating device and comprises a nozzle body 14 defining a seating area 9 and having an opening defining a flow passage extending through the seating area 9, wherein the opening is defined by an outer periphery 15. A plug element 1 is movably attached to the nozzle body 14 in the opening and selectively movable between closed and open positions relative thereto, wherein the plug element 1 is seated against the seating area 9 to close the flow passage in the closed position, and the plug element 1 is away from the seating area 9 to open the flow passage in the open position. In this embodiment, the plug element 1 has an outer diameter equivalent to an outer diameter of the opening of the nozzle body. A biasing member 4 (coil spring) is disposed with a stem 2 of the plug element 1 to bias the plug element 1 to the closed position. The biasing strength can be adjusted by tightening or loosening a nut (not shown) along threads 3. The biasing strength is adjusted so as to open an aperture at the outer periphery 15 of the opening in the open position to the extent that desired spray pattern 10 is discharged through the aperture when cooling fluid is supplied with pressure to an inner nozzle chamber 7 through housing passages 6. When the cooling fluid is not supplied with pressure to the inner nozzle chamber 7, the plug element 1 constantly stays in the closed position since the plug element 1 is biased to the closing direction by the biasing member 4 wherein the plug element 7 is seated against the seating area 9. The flow passage which is the aperture formed at the outer periphery 15 of the opening can be closed by placing the outer periphery 15 of the opening in line contact with, or alternatively in surface contact with, a portion of the plug element 1.

The plug element 1 is provided with a splitter member 11 fixed by screws 13 to a front face 8 of the plug element 1, wherein the splitter member 11 has at least one splitter arm 12 extending across the flow passage as viewed from the front of the plug element 1 to deflect flow 10 of fluid sprayed through the flow passage. The splitter member 11 (also the screws 13) may be made of an erosion-resistant material such as hardened 400 series steel, nickel-based super alloy, etc., or can be made of the same material as that of the plug element 1 and/or the nozzle body. The length of each splitter arm is greater than the outer diameter of the plug element 1 so as to deflect and split the spray pattern into two or more streams (segmented flow). Typically, each splitter arm is longer than the outer diameter of the nozzle body 14.

The nozzle body 14 may be fabricated as a single component (or alternatively two separate components threadably attached to each other) comprising an upper portion and a lower portion. The upper portion 5 may be threadably attached to a nozzle holder.

Figure 2:
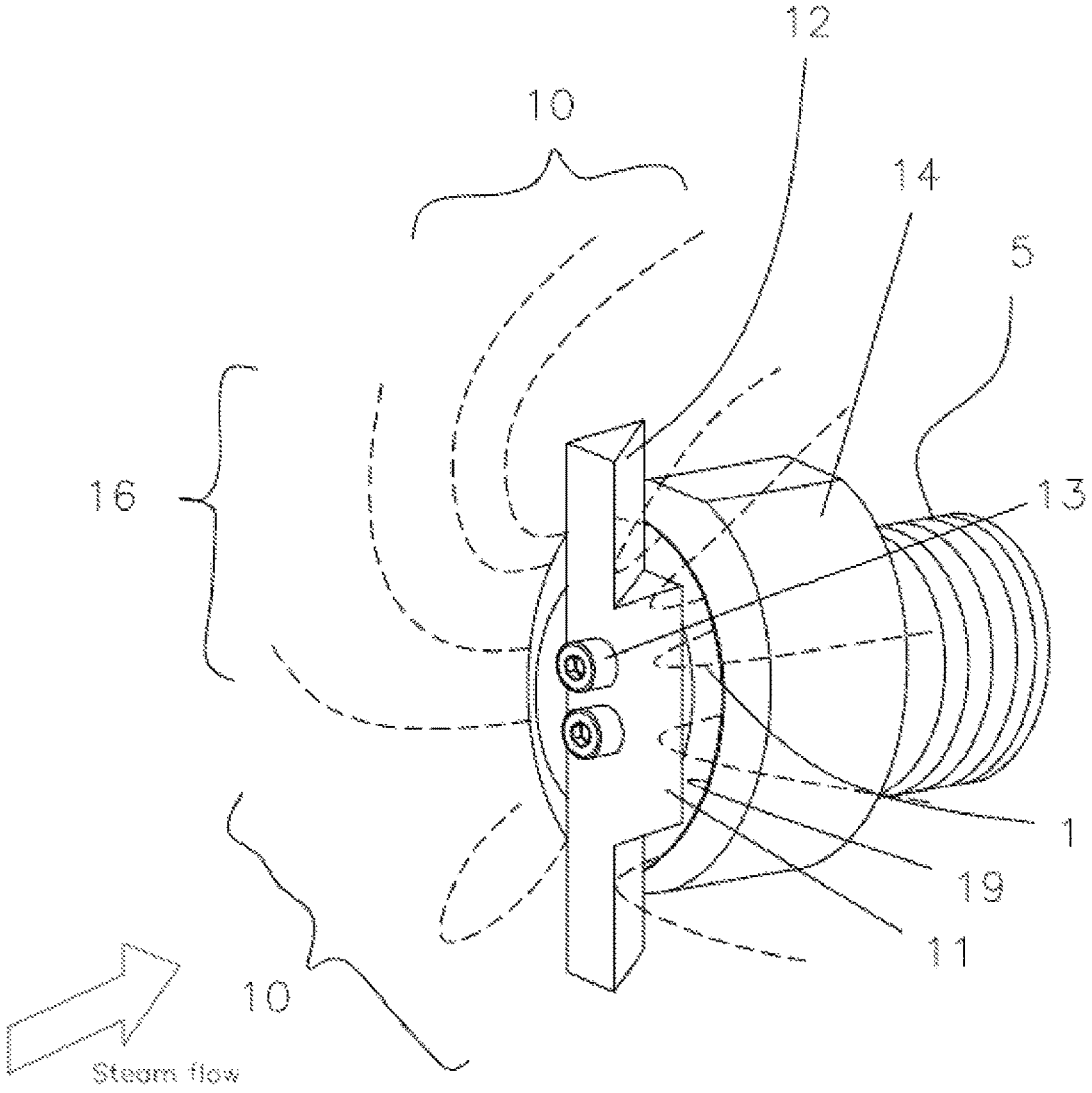
FIG. 2 is a schematic perspective view of the nozzle assembly illustrated in FIG. 1, wherein the broken lines schematically represent cooling fluid flow coming out of the nozzle assembly according to an embodiment of the present invention.

FIG. 2 is a schematic perspective view of the nozzle assembly illustrated in FIG. 1, wherein the broken lines schematically represent cooling fluid flow coming out of the nozzle assembly according to an embodiment of the present invention (counter flow injection). In this embodiment, the splitter member 11 has two splitter arms 12 symmetrically extending in opposite directions. In this embodiment, each splitter arm 12 has a cross section which is roughly a triangle with an apex facing the flow passage. The term "roughly a triangle" refers to any figure which can be approximately defined using three sides and three angles. The splitter arm 12 extends across the aperture 19 which is variable by the movement of the plug element 1 relative to the nozzle body 14 so as to produce a desired spray pattern. In some embodiments, the cross section of the splitter arm is a streamlined shape other than a triangle, or any other shape which is capable of deflecting the fluid flow in the desired directions.

In some embodiments, an angle at the apex of the triangle or other shapes is about 10° to about 90°, typically about 25° to about 60°, so that the splitter arm can effectively split the fluid sprayed out of the flow passage into two streams apart from each other by a distance slightly greater than a diameter of a feeding pipe to which the nozzle assembly is attached, when the bifurcated stream flows against the steam flow (counter flow injection) in a steam pipe, deflects to the direction of the steam flow, and passes through the feeding pipe, so as to avoid hitting the feeding pipe. The appropriate angle can be determined by a skilled artisan based on the velocity of steam, the velocity of spray, the mass of steam, the mass of spray, the width and thickness of the splitter arm, etc., through routine work. In some embodiments, the width (the size of the base of the triangle) of the splitter arm is about 10% to about 50% (typically 20% to 40%) of the outer periphery diameter of the aperture 19. In some embodiments, the width of the splitter arm is determined depending on the size of a fastening means, e.g., a screw, so as to securely fasten the splitter arm to the plug element. In some embodiments, the width (clearance) of the aperture when in operation is about 5% to about 20% (typically about 10%) of the outer periphery diameter of the aperture.

In FIG. 2, the fluid is sprayed out of the aperture 19 along the aperture 19 as indicated by broken lines 16, and due to the splitter arms 12, a cone of the sprayed fluid passing through the splitter arm 12 is split into two streams as indicated by broken lines 10.

Figure 3:
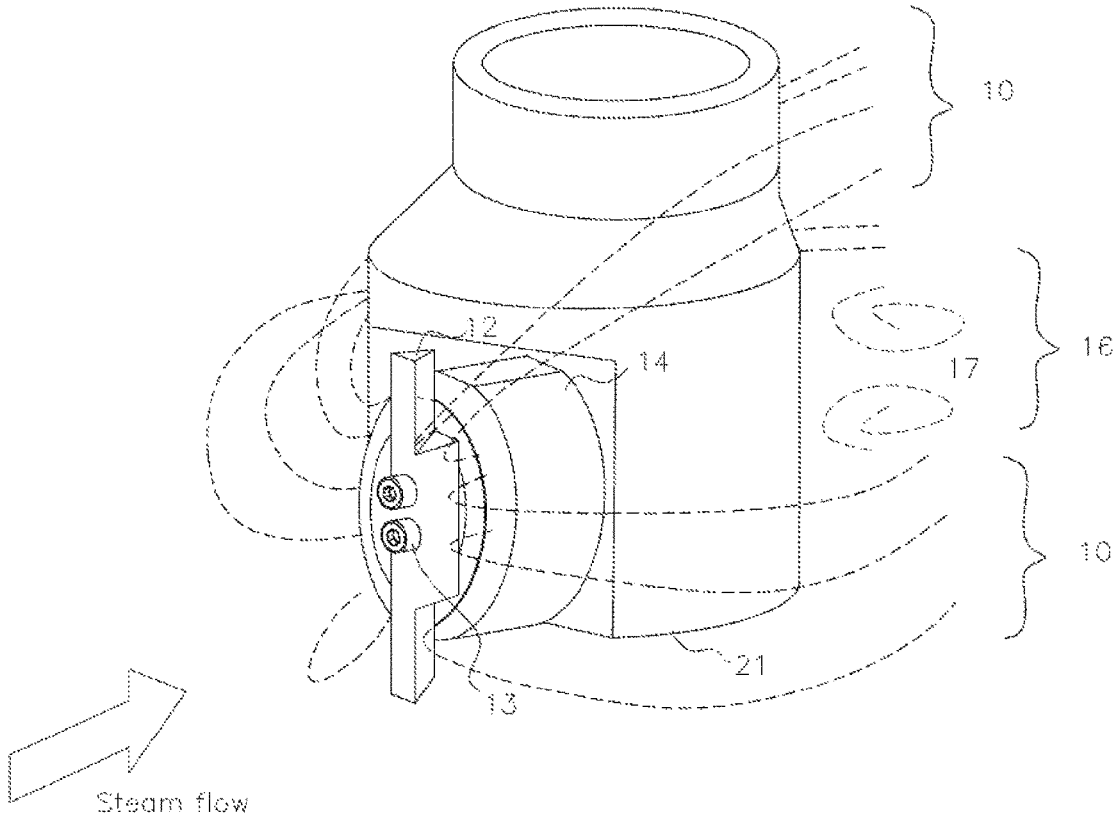
FIG. 3 is a schematic perspective view of a nozzle assembly illustrated in FIG. 2 installed in a nozzle holder of a probe-type steam-desuperheating device according to an embodiment of the present invention, wherein the broken lines schematically represent cooling fluid flow coming out of the nozzle assembly and being deflected by steam flow according to an embodiment of the present invention.

FIG. 3 is a schematic perspective view of a the nozzle assembly illustrated in FIG. 2 installed in a nozzle holder of a probe-type steam-desuperheating device according to an embodiment of the present invention, wherein the broken lines schematically represent cooling fluid flow coming out of the nozzle assembly and being deflected by steam flow according to an embodiment of the present invention. The nozzle assembly is attached to a nozzle holder 21 using the upper portion 5 (FIG. 1) of the nozzle body 14, wherein the lower portion of the nozzle body 14 is exposed outside. As illustrated in FIG. 3, when the nozzle assembly is placed in steam flow, the cooling fluid sprayed out of the flow passage of the nozzle assembly flows against the flow of the superheated steam, and deflects to the direction of the flow of the superheated steam due to the predominant stream of the steam as indicated by broken lines 10 and 16, wherein the cooling fluid sprayed out of the flow passage of the nozzle assembly is split into two streams by the splitter arms 12, which streams pass through the feeding pipe (and the nozzle holder) without hitting the feeding pipe (and the nozzle holder) as indicated by the broken lines 10 and 16. In the above, the splitter arms 12 extend in a direction in which the feeding pipe extends from the nozzle holder 21 (the vertical direction in this figure).

In this embodiment, two splitter arms 12 are used. Although the lower splitter arm is not used for avoiding hitting of the feeding pipe by the cooling fluid, it is useful for improving the mixing of the sprayed cooling fluid and the superheated steam (by drawing in additional superheated steam into regions where water droplets are concentrated) and increasing the evaporation rate of the sprayed cooling fluid so as to efficiently cool the superheated steam, wherein effective turbulence including eddies 17 occurs. When the splitter arms split the spray pattern, the spray pattern is divided into multiple segments, i.e., segmentation of the spray pattern. The segmentation of the spray pattern can entrain surrounding hot steam inside the core of the spray pattern, i.e., hot steam flows through the gaps between the segments and is enveloped by the cooling fluid flow, improving the mixing of the steam and the sprayed cooling fluid and increasing the evaporation rate of the cooling fluid, which are desirable in desuperheating devices.

In some embodiments, alternatively, the nozzle assembly can be used in concurrent flow injection (co-flowing with the steam), i.e., spraying the cooling fluid in the same direction as that of the steam so that the sprayed fluid will not hit the feeding pipe; however, cooling efficiency of the concurrent flow injection may not as good as that of the counter flow injection. In some embodiments, the velocity of steam in the steam pipe is about 8 m/s to about 100 m/s, whereas the initial velocity of spray is about 20 m/s to about 30 m/s, wherein the pressure difference between the steam flowing in the steam pipe and the fluid to be sprayed is about 1 bar or higher to ensure good atomization of the cooling fluid, but about 15 bar or less to prevent erosion of the nozzle assembly. In some embodiments, the velocity of spray is greater than that of steam.

Figure 4:
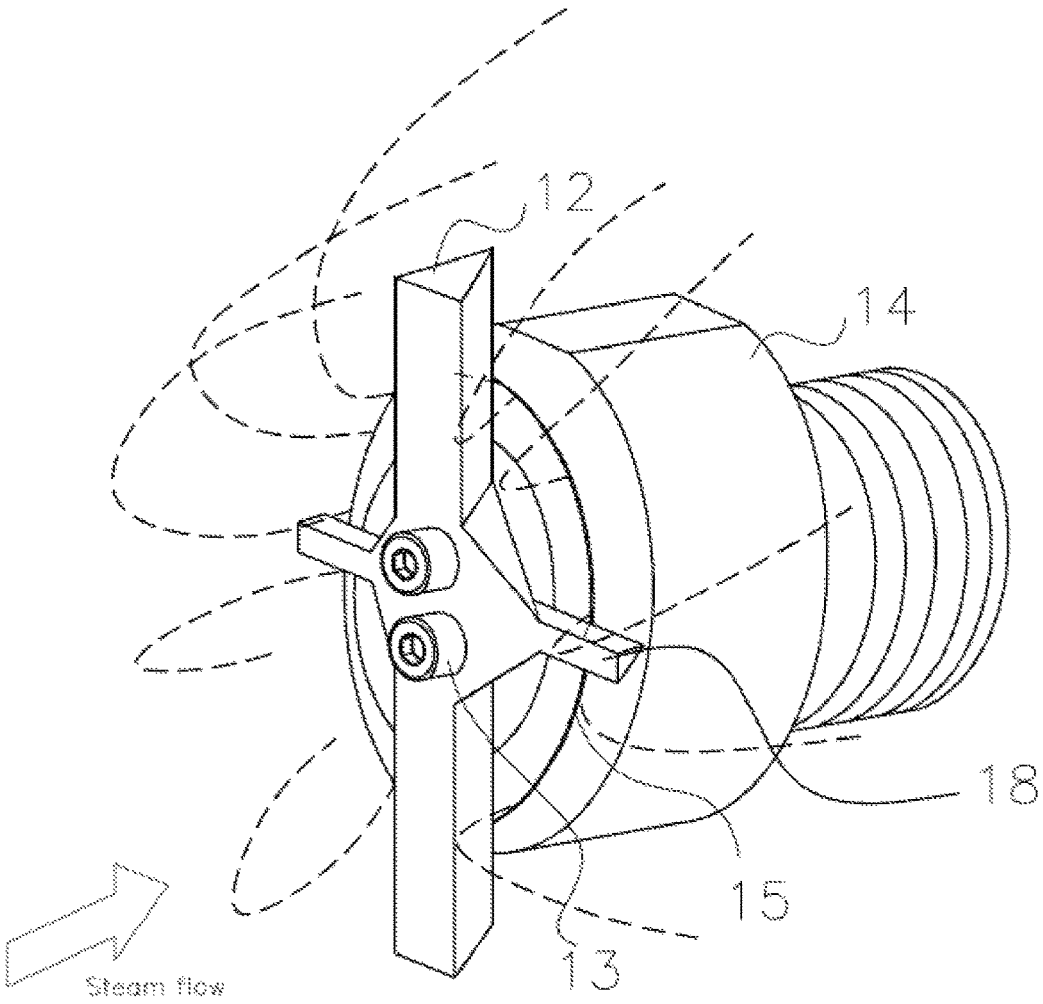
FIG. 4 is a schematic perspective view of a nozzle assembly according to another embodiment of the present invention, wherein the broken lines schematically represent cooling fluid flow coming out of the nozzle assembly.

FIG. 4 is a schematic perspective view of a nozzle assembly according to another embodiment of the present invention, wherein the broken lines schematically represent cooling fluid flow coming out of the nozzle assembly. In this embodiment, the number of the splitter arms is four, wherein two main splitter arms 12 and two secondary splitter arms 18 symmetrically extend in four directions. The secondary splitter arms 18 are smaller than the main splitter arms 12, since the horizontally extended splitter arms 18 are not used to avoid hitting the feeding pipe and are used for improving mixing of the sprayed fluid and the steam as described above (the segmentation effect). In some embodiments, the number of the splitter arms may be 3 or 5.

Figure 5A:
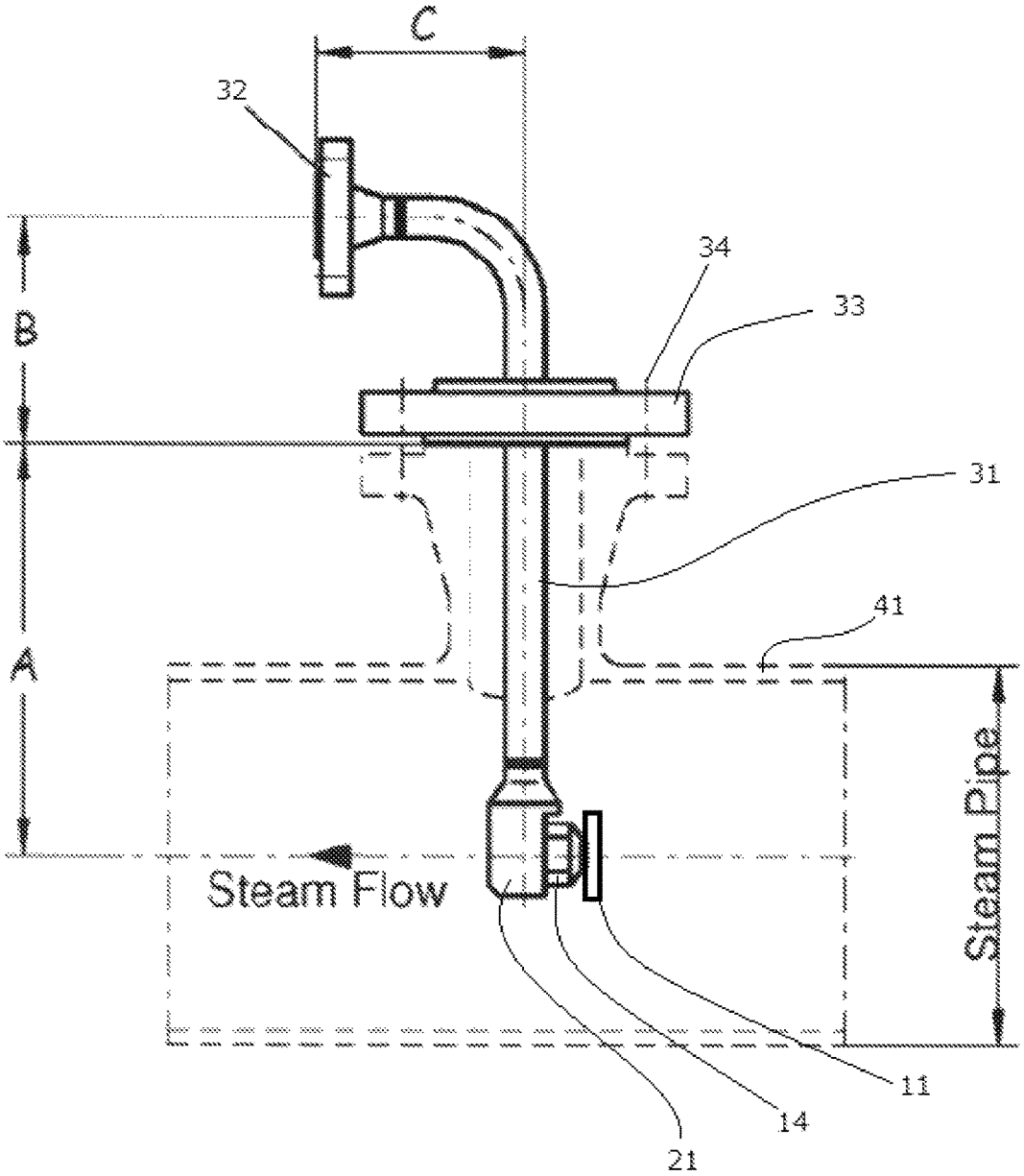
FIG. 5A is a schematic side view of a probe-type steam-desuperheating device when it is inserted in a steam pipe according to an embodiment (counter flow) of the present invention, wherein the steam pipe is shown by broken lines.

FIG. 5A is a schematic side view of a probe-type steam-desuperheating device when it is connected to a steam pipe according to an embodiment (counter flow) of the present invention, wherein the steam pipe is shown by broken lines. In this embodiment, the probe-type steam-desuperheating device comprises: a feeding pipe 31 for feeding cooling fluid having a lower end and an upper end; a nozzle holder 21 attached to the lower end of the feeding pipe 31; a cooling fluid inlet port 32 disposed at the upper end of the feeding pipe 31; a flange 33 provided in the feeding pipe 31, for attaching the feeding pipe 31 to a steam pipe 41; and the nozzle assembly 14 disclosed herein attached to the nozzle holder 21 in a manner such that an axis of the plug element is parallel to an axis of the steam pipe 31. The length of the feeding pipe 31 between the flange 33 and the nozzle holder 21 is set such that the axis of the plug element is aligned generally or substantially with the axis of the steam pipe. In alternative embodiments, the axis of the plug element is not aligned with the axis of the steam pipe where the axis of the plug element is angled relative to the axis of the steam pipe or where multiple plug elements are used, for example. The nozzle assembly 14 is provided with the splitter member 11 facing the steam flow. The flange 33 is fixedly attached to a nozzle port of the steam pipe using steam studs 34 or the like. In some embodiments, the feeding pipe is straight and the cooling fluid inlet port 32 faces in an upward direction. In some embodiments, the dimensions of the feeding pipe are as follows: A (defined in FIG. 5A) depends on the size of the target steam pipe, B (defined in FIG. 5A) is about 175 mm, and C (defined in FIG. 5A) is about 175 mm to about 250 mm. A skilled artisan can readily make proper selection of the dimensions based on this disclosure through routine work.

Figure 5B:
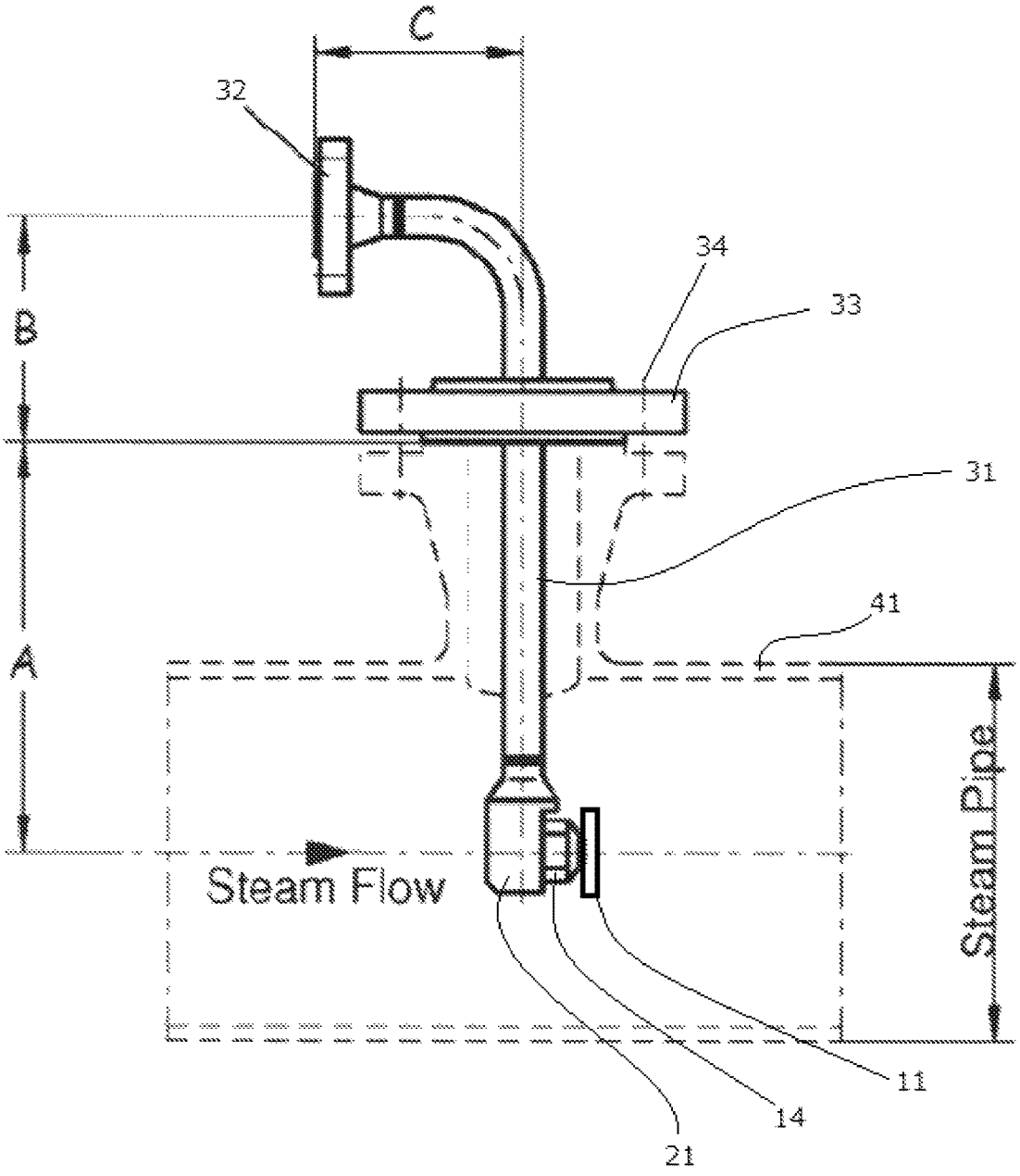
FIG. 5B is a schematic side view of a probe-type steam-desuperheating device when it is inserted in a steam pipe according to another embodiment (concurrent flow or co-flowing with the steam) of the present invention, wherein the steam pipe is shown by broken lines.

FIG. 5B is a schematic side view of a probe-type steam-desuperheating device when it is inserted in a steam pipe according to another embodiment (concurrent flow or co-flowing with the steam) of the present invention, wherein the steam pipe is shown by broken lines. This embodiment is substantially the same as the embodiment shown in FIG. 5A, except that the cooling fluid is sprayed toward the downstream direction of the steam. The cooling fluid sprayed out of the flow passage of the nozzle assembly 14 is split into two streams (two segments) by the splitter member 11, between which streams part of the steam passes, thereby desuperheating the steam while the steam is passing through the sprayed cooling fluid.

Figure 6:
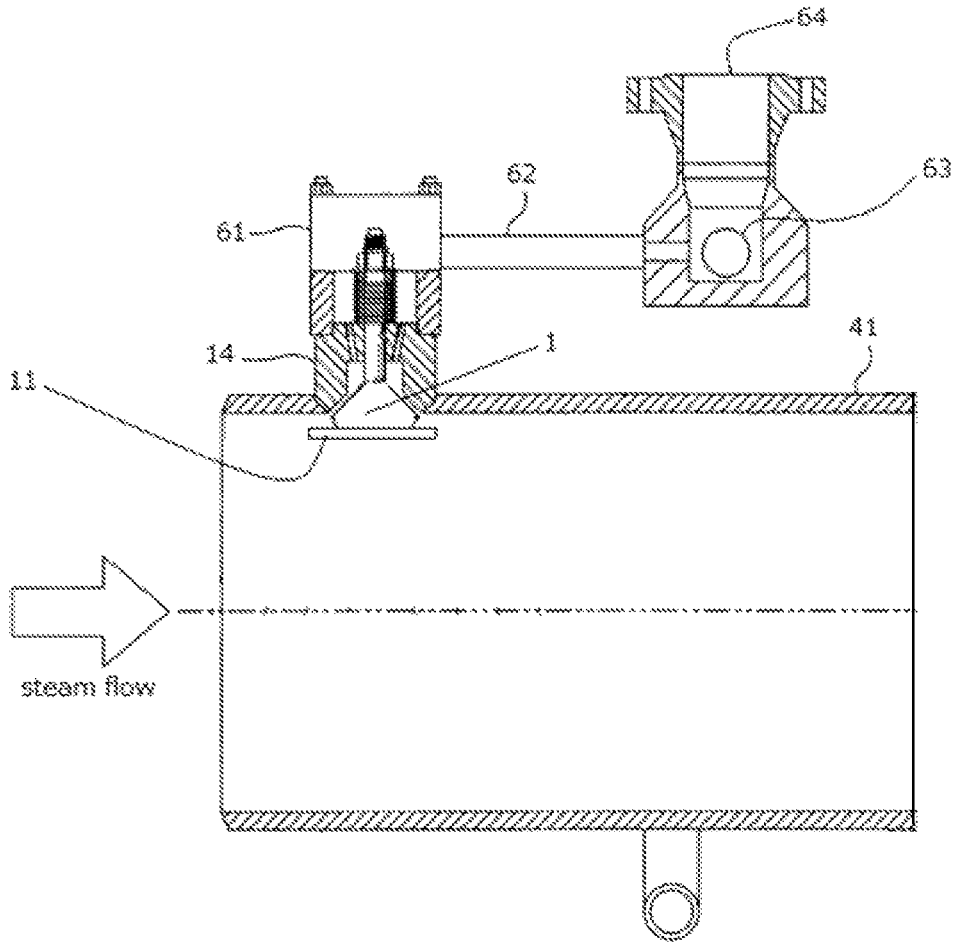
FIG. 6 is a schematic side cross sectional view of a multi-nozzle ring-type steam-desuperheating device when it is installed in a steam pipe according to an embodiment of the present invention.
Figure 7:
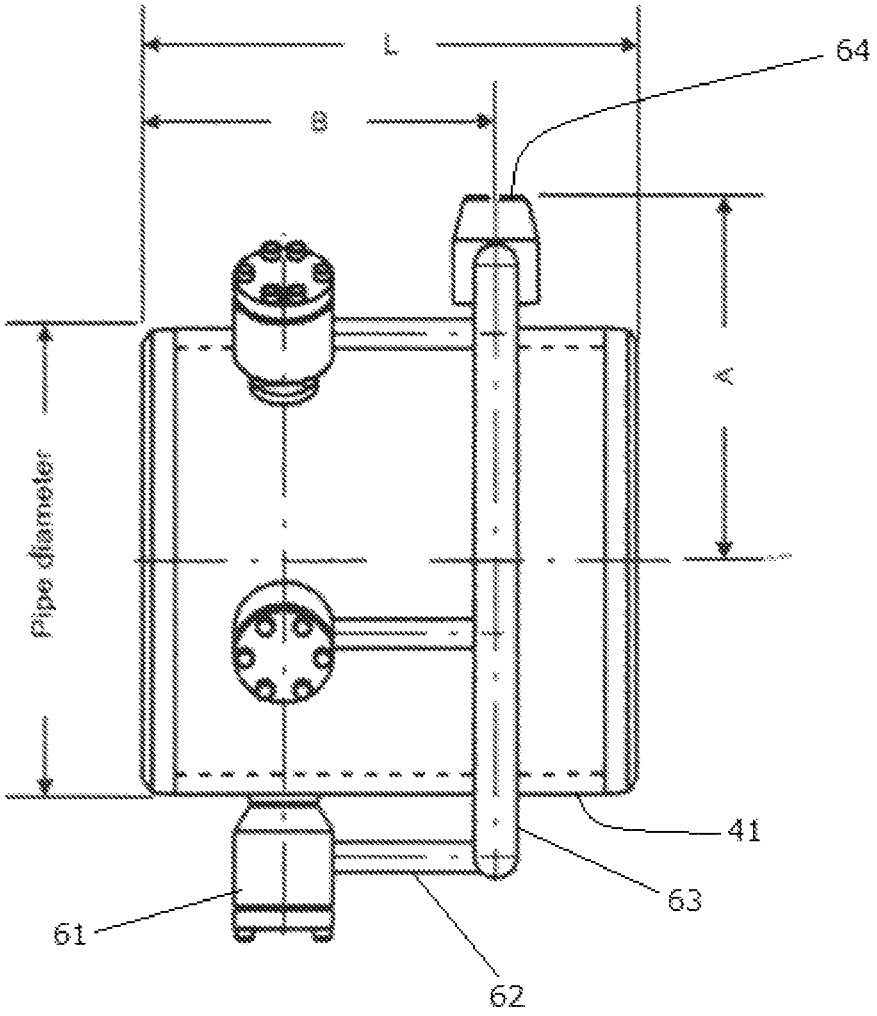
FIG. 7 is a schematic side view of a multi-nozzle ring-type steam-desuperheating device when it is installed in a steam pipe according to an embodiment of the present invention.

FIG. 6 is a schematic side cross sectional view of a multi-nozzle ring-type steam-desuperheating device when it is connected to a steam pipe according to an embodiment of the present invention. In this embodiment, the mixing of the steam and the sprayed fluid and the evaporation rate of the sprayed fluid can be increased by using any of the nozzle assemblies disclosed herein as described above (the segmentation effect). FIG. 7 is a schematic side view of a multi-nozzle ring-type steam-desuperheating device when it is connected to a steam pipe according to an embodiment of the present invention. In the above, a multi-nozzle ring-type steam-desuperheating device comprises: a circular feeding pipe 63 with multiple branches 62 for feeding cooling fluid having multiple branch ends and an upper end; multiple nozzle housings 61 attached to the multiple branch ends of the branches 62, respectively; a cooling fluid inlet port 64 disposed at the upper end of the feeding pipe 63; and a plurality of the nozzle assemblies disclosed herein situated in the nozzle housings 61, respectively, in a manner such that each nozzle assembly is configured to gas-tightly communicate with the interior of a steam pipe 41, and an axis of each plug element 1 is perpendicular to an axis of the steam pipe 41. In this embodiment, each nozzle body 14 communicates gas-tightly with the interior of the steam pipe 41. Also, the nozzle arm 11 extends along an axis of the steam pipe 41 so as to improve the mixing of the steam and the sprayed fluid.

In some embodiments, in FIG. 7, the dimensions of the apparatus are as follows: L (defined in FIG. 7) is about 650 mm to 1,400 mm, A (defined in FIG. 7) is about 280 mm to about 950 mm, B (defined in FIG. 7) is about 450 mm to about 920 mm, and the typical pipe diameter is about 200 mm to about 1,500 mm. A skilled artisan can readily make proper selection of the dimensions based on this disclosure through routine work.

In some embodiments, the nozzle assembly structures and other structures associated therewith disclosed in U.S. Pat. Nos. 6,746,001, 7,850,149, and 8,931,717, and WO 2014/055691 can be employed to the full extent consistent with this disclosure, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A probe-type steam-desuperheating device comprising:

a feeding pipe for feeding cooling fluid, having a lower end and an upper end;

a nozzle holder attached to a lowermost tip of the lower end of the feeding pipe;

a cooling fluid inlet port disposed at the upper end of the feeding pipe;

a flange provided on the feeding pipe, for attaching the feeding pipe to a steam pipe, said feeding pipe being attached indirectly to the steam pipe solely via and at the flange; and a nozzle assembly, for spraying cooling fluid into the steam pipe, attached to the nozzle holder in a manner such that an axis of the plug element is parallel to an axis of the steam pipe, wherein the nozzle assembly comprises:

a nozzle body defining a seating area and having an opening defining a flow passage extending through the seating area, through which flow passage, cooling fluid is sprayed in the steam-desuperheating device;

a plug element movably attached to the nozzle body in the opening and selectively movable between closed and open positions relative to the opening, wherein the plug element is seated against the seating area to close the flow passage in the closed position, and the plug element is away from the seating area to open the flow passage in the open position, wherein a spray angle of the cooling fluid is defined by an angle of the flow passage with respect to an axis of the plug element; and a splitter member fixed to a front face of the plug element downstream of the seating area, said splitter member having at least one splitter arm extending across the flow passage as viewed from the front of the plug element to deflect flow of fluid sprayed through the flow passage, wherein the splitter arm is disposed apart from an outer periphery of the opening, wherein a length of the feeding pipe between the flange and the nozzle holder is set such that the axis of the plug element is aligned substantially with the axis of the steam pipe, wherein the nozzle holder is disposed in a direction such that the front face of the plug element faces an upstream direction of steam flowing through the steam pipe, and the splitter arm extends in a direction in which the feeding pipe extends from the nozzle holder in a manner such that the cooling fluid sprayed from the nozzle assembly into the upstream direction of steam is deflected to pass around the feeding pipe.

2. The probe-type steam-desuperheating device according to claim 1, wherein the at least one splitter arm of the nozzle assembly has a cross section which is roughly a triangle with an apex facing the flow passage.

3. The probe-type steam-desuperheating device according to claim 2, wherein an angle at the apex of the triangle is 25° to 60°.

4. The probe-type steam-desuperheating device according to claim 1, wherein the at least one splitter arm of the nozzle assembly is constituted by two splitter arms symmetrically extending in opposite directions.

5. The probe-type steam-desuperheating device according to claim 1, wherein the at least one splitter arm of the nozzle assembly is constituted by four splitter arms symmetrically extending in four directions.

6. The probe-type steam-desuperheating device according to claim 1, wherein the nozzle assembly further comprises a biasing member disposed with a stem of the plug element to continuously bias the plug element toward the closed position.

7. The probe-type steam-desuperheating device according to claim 1, wherein the plug element of the nozzle assembly has an outer diameter equivalent to an outer diameter of the opening of the nozzle body.

8. The probe-type steam-desuperheating device according to claim 1, wherein the splitter member of the nozzle assembly is fixed to the front face of the plug element with screws.

9. A method of desuperheating steam using the probe-type steam-desuperheating device of claim 1, comprising:

supplying superheated steam in the steam pipe upstream of the probe-type steam-desuperheating device;

feeding cooling fluid to the cooling fluid inlet port of the probe-type steam-desuperheating device and spraying the cooling fluid from the nozzle assembly against flow of the superheated steam, thereby desuperheating the superheated steam while the superheated steam is passing through the probe-type steam-desuperheating device, wherein the cooling fluid sprayed out of the flow passage of the nozzle assembly flows against the flow of the superheated steam, and deflects to a direction of the flow of the superheated steam, wherein the cooling fluid sprayed out of the flow passage of the nozzle assembly is split apart into two streams by each splitter arm in a manner that the streams pass around the feeding pipe without hitting the feeding pipe; and obtaining the desuperheated steam downstream of the probe-type steam-desuperheating device.

10. The method according to claim 9, wherein the at least one splitter arm is constituted by multiple splitter arms symmetrically extending in multiple directions, thereby creating uniform steam entrainment to the sprayed cooling fluid.

11. The method according to claim 9, wherein the steam is water vapor, and the cooling fluid is water.

* * * * *